United States Patent [19]

Tanel

[11] Patent Number: 4,669,204

[45] **Date of Patent: * Jun. 2, 1987**

[54] PIVOTING ATHLETIC SHOE

[75] Inventor: Michael L. Tanel, Milwaukee, Wis.

[73] Assignee: Tanel Corporation, Milwaukee, Wis.

[ * ] Notice: The portion of the term of this patent subsequent to Mar. 25, 2003 has been disclaimed.

[21] Appl. No.: 854,409

[22] Filed: Apr. 21, 1986

Related U.S. Application Data

[63] Continuation-in-part of Ser. No. 800,740, Nov. 22, 1985, which is a continuation-in-part of Ser. No. 565,746, Dec. 27, 1983, Pat. No. 4,577,422.

[51] Int. Cl.[4] ..... A43B 5/02; A43B 5/00; A43C 15/16

[52] U.S. Cl. ..... 36/126; 36/128; 36/134; 36/59 C; 36/67 R

[58] Field of Search ..... 36/32 R, 126, 127, 128, 36/129, 134, 59 C, 59 R, 67 R, 67 A, 114

[56] References Cited

U.S. PATENT DOCUMENTS

| | | | |
|---|---|---|---|
| 825,869 | 7/1906 | Sandeman | 36/132 |
| 844,057 | 2/1907 | Tillinghast | 36/132 |
| 1,552,022 | 9/1925 | Willson | 36/59 C |
| 1,736,576 | 11/1929 | Cable | 36/59 C |
| 2,261,785 | 11/1941 | Youmans | 36/73 |
| 2,365,027 | 12/1944 | Urband | 36/59 C |
| 2,677,905 | 5/1954 | Dye | 36/128 |
| 2,678,507 | 5/1954 | Dye | 36/128 |
| 3,271,885 | 9/1966 | McAiriffe | 36/134 |
| 3,466,763 | 9/1969 | Levin | 36/92 |
| 3,707,047 | 12/1972 | Nedwick | 36/114 |
| 4,347,674 | 9/1982 | George | 36/67 R |
| 4,569,142 | 2/1986 | Askinasi | 36/32 R |
| 4,577,422 | 3/1986 | Tanel | 36/126 |

FOREIGN PATENT DOCUMENTS

| | | | |
|---|---|---|---|
| 866767 | 12/1952 | Fed. Rep. of Germany | 36/128 |

*Primary Examiner*—Henry S. Jaudon
*Assistant Examiner*—Steven N. Meyers
*Attorney, Agent, or Firm*—Peter N. Jansson

[57] ABSTRACT

An athletic shoe for field sports having a substantially continuous annular cleat formed on the sole in forward position and extending along a substantially circular path encompassing a major area which includes most of the ball-of-the-foot and toe portions of the sole. The cleat has a passageway across a portion of the width of the sole just forward of the arch portion. Such passageway is preferably a shortening of a minor portion of the annular cleat but may be elimination thereof. Some preferred embodiments relate to a flat cleat edge, while others relate to certain passageway or cleat cross-sectional characteristics.

17 Claims, 5 Drawing Figures

PIVOTING ATHLETIC SHOE

RELATED APPLICATION

This is a continuation-in-part of my copending patent application Ser. No. 800,740, filed Nov. 22, 1985, entitled ATHLETIC SHOE WITH IMPROVED PIVOT CLEATING, which in turn is a continuation-in-part of my patent application Ser. No. 565,746, filed Dec. 27, 1983, entitled ATHLETIC SHOE WITH IMPROVED PIVOT CLEATING, now U.S. Pat. No. 4,577,422.

FIELD OF THE INVENTION

This invention is related generally to athletic shoes of the type having cleats, such as football shoes, and, more specifically, to athletic shoes with cleating facilitating pivoting movements.

BACKGROUND OF THE INVENTION

Most athletic shoes used for field sports, such as football, baseball, softball, soccer, and lacrosse, have a number of either tapered or blade-like cleats for the purpose of increasing traction. Cleats dig into the turf to prevent slipping during starting, stopping, and cutting maneuvers.

Such cleats, however, in addition to providing desirable traction for starting, stopping and cutting, typically provide very undesirable resistance to pivoting. This can be a disadvantage in two ways.

When pivoting is inhibited, the maneuverability of the athlete is limited. His performance is less than it could be. Enhancing the ability of a player to pivot can greatly increase his effectiveness on the field.

In addition to inhibiting certain pivoting actions which athletes attempt or would like to attempt, many cleats of the prior art tend to resist turning movements which can relieve stresses within the leg when unwanted torque or force is applied to the athlete, particularly to the athlete's leg. If a twising moment is forcibly applied to a leg at a time when the cleats are firmly planted into the turf and release from the turf is not possible, injuries can result, particularly common knee injuries.

Some athletic shoes have cleats intended to accommodate pivoting movements. One approach has used fixed annular cleats. The performance of such shoes can vary greatly, depending on various factors. However, the annular-cleated athletic shoe of the aforementioned U.S. Pat. No. 4,577,422 provides greatly improved pivotability and unexcelled traction, and reduces the chance of athletic injuries.

The improvement in pivotability made possible with shoes in accordance with the principles of such patent is dramatic, and such shoes give the athletes wearing them a natural feeling of freedom together with a good feeling of traction for stopping, starting and cutting.

The invention described and claimed herein relates generally to athletic shoes having substantially continuous annular cleats. The substantially continuous annular cleats are modified to provide particular advantages. In some cases, modifications in the substantially continuous ring can significantly improve the performance of such shoes.

It has been found that in some forms athletic shoes in accordance with U.S. Pat. No. 4,577,422 may make a snapping or clapping sound during running on wet ground—particularly when the athlete is running backwards. This may be considered a negative factor, and it may be desirable to modify the annular cleat to reduce or eliminate such sound.

Another concern relates to the degree of penetration of the substantially continuous annular cleat and the effect that that can have on how well the shoe functions. For example, if there is insufficient ground penetration of the annular cleat, there will be less traction than is desirable and less ground bearing than is needed to achieve the best possible pivotability.

Consideration must be given to the total cleat end area—that is, the total area of the distal surface(s) of the cleat or cleats. The greater the total end area bearing on the ground, the more difficult it may be for an annular cleat to penetrate the ground; the smaller the total end area bearing on the ground, the easier is may be for an annular cleat to penetrate the ground. This affect is accentuated when the ground is hard. While sharping the distal end of the annular cleat reduces the total area of the distal surface, it may also cause some concern about injury from player contact with such sharp edges.

Resolution of these conflicting concerns may require development of an improvement in shoes with substantially continuous annular cleats. The cleating of such shoes should provide good ground penetration to insure the aforementioned excellent combination of traction and pivotability in a comfortable functional athletic shoe.

This invention is directed toward such improvements in cleated shoes of the type having substantially continuous annular cleats.

Before describing the invention, a brief description of the foot and its pivoting and planted positions will be helpful. This can serve as an aid in understanding preferred embodiments of this invention.

The sole of the foot includes four basic portions. These are, in order back to front: the heel portion; the arch portion; the ball-of-the-foot portion; and the toe portion. The heel portion and the ball-of-the-foot portion are those portions which share most if not all of the player's weight when the player is in a normal standing position with his feet generally flat on the ground. In such position, the arch portion and toe portion bear little if any weight.

When a player is "on his toes" in a "ready" position, virtually all of the player's weight is normally shared by the toe portion and the ball-of-the-foot portion. The same is usually true when a player is "digging" in a running action. Indeed, when a player is in the ready position the juncture of the phalanges (toe bones) and the metatarsles is the center of weight bearing. In other words, the center weight bearing in the forward portions of the foot actually moves forward when a player shifts to the ready position.

The sole of an athletic shoe has portions immediately below such four foot portions which may be designated, and herein are designated, by the same terms.

BRIEF SUMMARY OF THE INVENTION

This invention is an improved athletic shoe for field sports providing excellent controlled pivotability and traction in a commercially desirable form. Furthermore, the shoe of this invention makes does not make any excessive noise even when running backwards on particularly wet ground.

The sole of the athletic shoe of this invention includes a substantially continuous annular cleat extending along a substantially circular path encompassing a major sole area which includes most of the ball-of-the-foot and toe portions of such sole. Such path is forward of the arch portion. The annular cleat substantially spans the width of the sole and has a distal edge a major portion of which is in a plane spaced from the main sole surface.

The distal edge of the annular cleat is preferably a flat surface. This bluntness improves the safety of the shoe. And, in the configuration of this invention such bluntness does not significantly detract from the ground penetration which is needed for good traction and pivotability.

A passageway is in the annular cleat between the main sole surface and the aforementioned plane and extending from a first position on the ball-of-the-foot portion of the sole near the arch portion across a portion of the width of the sole to a second position which is also on the ball-of-the-foot portion near the arch portion.

In a preferred embodiment, the annular cleat is shortened between the aforementioned first and second positions, and the distal edge forms a concave length between such positions. Such convcave length has a center portion which converges toward the main sole surface such that the annular cleat is progressively shorter in length at positions progressively closer to the midpoint between the first and second positions.

The passageway which forms a part of this invention can take other forms. For example, rather than a shortening of the annular cleat there can be an elimination of such cleat between the aforesaid two positions. Surprisingly, such void, in the position just forward of the arch portion of the sole, does not detract from the pivoting performance of the shoe, even though such void is on the ball-of-the-foot portion of the sole.

The annular cleat, rather than being a number of widely separated individual cleats, remains a single cleat and is appropriately described as "substantially continuous."

Such passageway provides certain important advantages. Eliminating or drastically recessing the portion of the annular cleat allows a greater amount of the athlete's weight to be applied to the ground through the remaining portion of the cleat—namely, through the aforementioned major portion of the distal edge of the cleat. This improves the degree of ground penetration and helps to insure provide good traction and provide a good base for pivoting.

The passageway allows air to pass out of the space enclosed by the annular cleat, the main sole surface, and the ground as the player's foot bites into the ground. This tends to reduce or even eliminate the aforementioned clapping sound. Such sound was caused, it is believed, by compressed within such space being suddenly released through a small space such as any irregularity in the ground.

The annular cleat has radially-inward and outward annular lateral surfaces which converge to the distal edge. The outward lateral surface is normal (that is, perpendicular) to main sole surface. This helps to provide as wide a base as possible to support the foot of the athlete. The inward lateral surface flares radially outwardly to the distal edge and is curved in cross-section to merge gently with the main sole surface. This tends to minimize the accumulation of mud, which is a major problem with some field sport shoes of the prior art.

The annular cleat preferably is centered about the portion of the sole beneath the juncture of the phalanges and the metatarcles, that is, at the juncture of the ball-of-the-foot and toe portions of the sole. All non-cleat areas of the sole area enclosed by such annular cleat are preferably coincident with the main sole surface; that is, such surfaces are not built up. This allows full turf penetration by the annular cleat or cleats.

In some preferred embodiments, the circular cleat is the forwardmost cleat on the shoe. In some embodiments, a central cleat, preferably of the standard tapered frustoconical shape, is disposed concentrically within the circular cleat.

OBJECTS OF THE INVENTION

It is an object of this invention to provide an improved pivoting athletic shoe.

Another object of this invention is to provide an athletic shoe having both improved pivotability and excellent traction.

Another object of this invention is to provide an athletic shoe of the type having a substantially continuous annular cleat which makes little or no snapping or clapping sound when used on wet fields.

Another object of this invention is to provide an athletic shoe with a substantially continuous annular cleat which penetrates the ground well to enhance its improved pivotability and good traction.

Yet another object of this invention is to provide an improved athletic shoe which reduces the risk of common injuries, such as knee injuries.

These and other objects will be apparent from the following additional descriptions, including the drawings wherein:

DETAILED DESCRIPTION OF PREFERRED EMBODIMENTS

The figures illustrate a preferred athletic shoe 10 in accordance with this invention. Shoe 10 has a upper 12 and a sole 14 affixed together in the normal way. The make-up of upper 12 is not a part of this invention, and upper 12 may be made of conventional materials such as leather, canvass and the like. Sole 14 is made of material which is tough and wear-resistant but which can flex in the normal manner depending on how weight is applied to it. Sole 14 is preferably formed of polyurethane or rubber.

The lower surface of sole 14, which contacts the surface of the playing field, includes a main sole surface 16 which is a generally flat even surface from which cleats project. The cleats are preferably integrally formed with main sole surface 16 in a molding process of well-known type.

Figure 1:
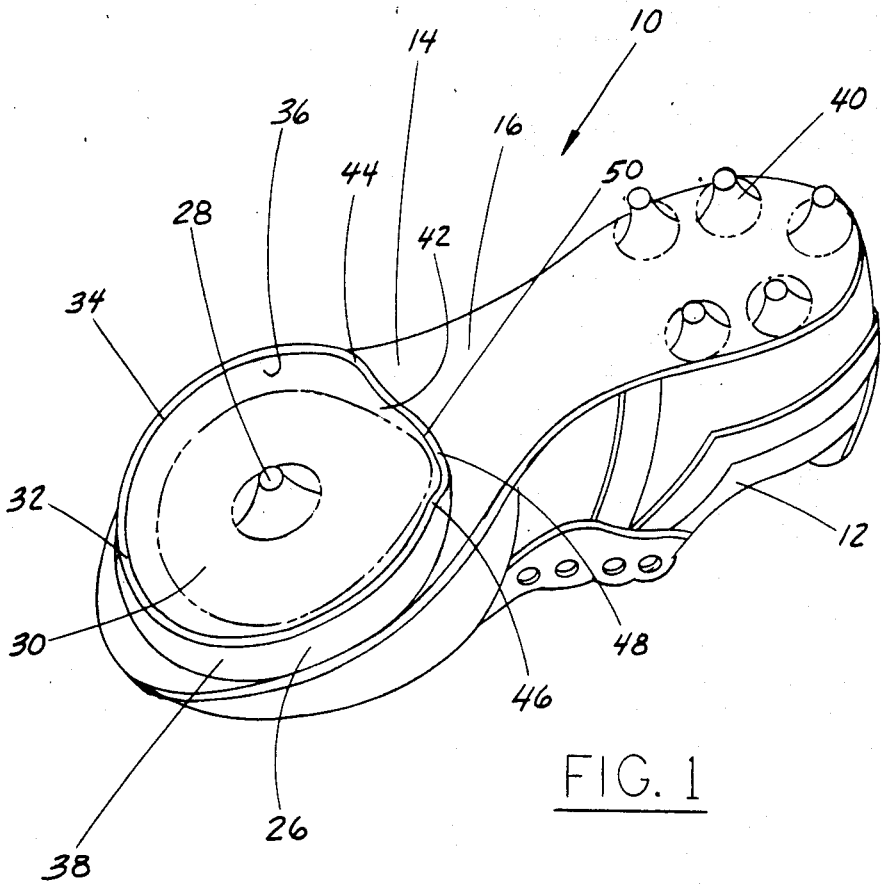
FIG. 1 is a sole-up perspective view of a preferred athletic shoe in accordance with this invention.
Figure 2:
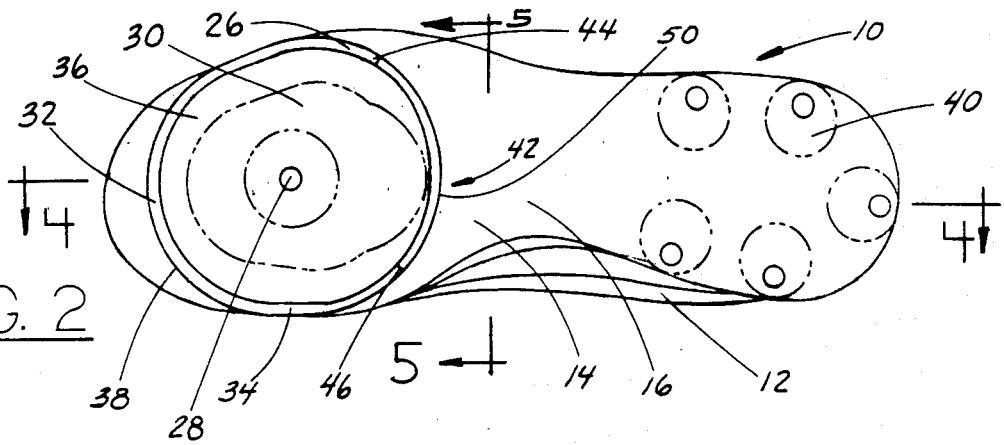
FIG. 2 is a plan view of FIG. 1.
Figure 3:
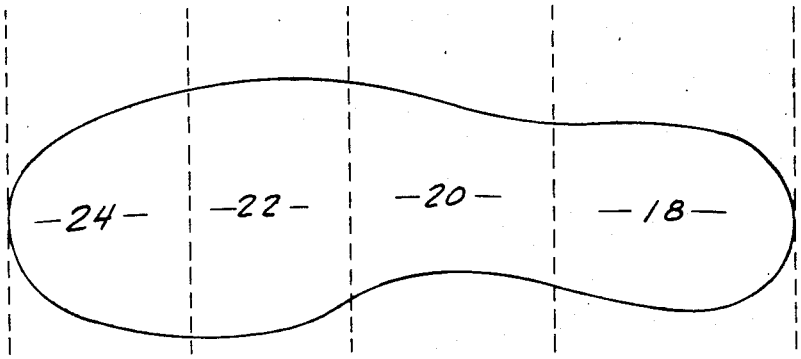
FIG. 3 is a cleatless schematic plan view of an athletic shoe sole, illustrating the portions thereof.

As illustrated in schmetatic FIG. 3, the sole has four portions which are defined by the portions of the foot adjacent to them. These sole portions are: a heel portion 18, immediately below the player's heel; an arch portion 20, below the arch of the player's foot; a ball-of-the-foot portion 22, below the ball of the player's foot; and a toe portion 24, below the player's toes.

Figure 4:
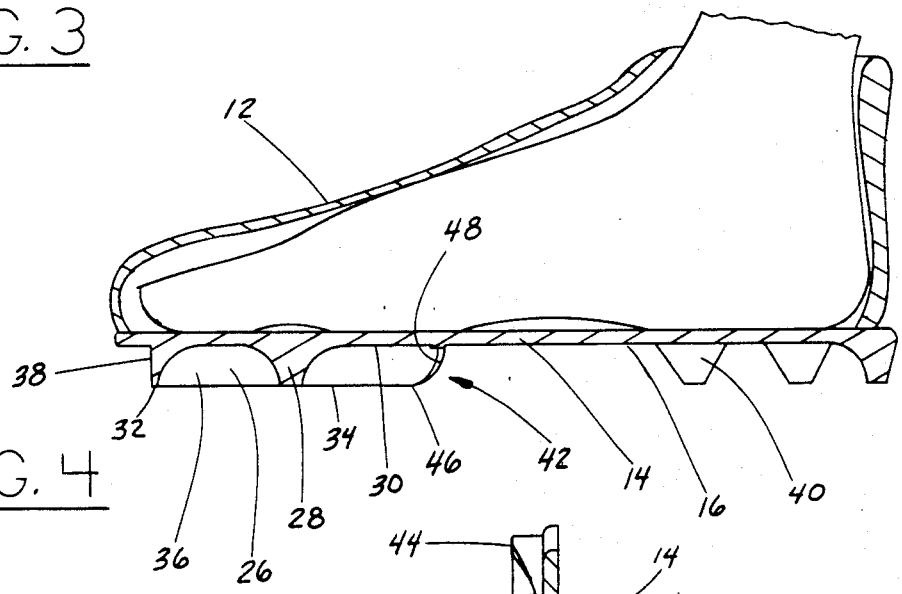
FIG. 4 is a sole-down sectional view, taken along section 4—4 as shown in FIG. 2, including a player's foot.

As previously noted, the ball of the foot and the heel bear weight when the player is standing in a flat-footed stance, as in FIG. 4, while the toe and ball-of-the-foot portions bear weight when the player is in the ready position.

A substantially continuous annular cleat 26 projects from main sole surface 16. Annular cleat 26 is centered on the juncture of the ball-of-the-foot and toe portions 22 and 24, respectively, and spans the width of sole 14. Annular cleat 26 extends along a substantially circular path all of which is forward of arch portion 20. Annular cleat 26 encompasses a major area which includes most of ball-of-the-foot and toe portions 22 and 24, respectively; indeed, cleat 26 encompasses substantially the entire area of such portions.

A standard frustoconical cleat 28 is located at or very close to the center point of annular cleat 26. Annular cleat 26 encloses a sole area 30 all of which, except for center cleat 28, is coincident with main sole surface 16. That is, there are no built-up portions in enclosed sole area 30 which can retard penetration of the playing surface by annular cleat 26 and center cleat 28. Sole area 30, however, may have texturing which may have some controlling effect on pivoting.

Annular cleat 26 terminates in a distal edge 32 which is preferably a flat surface, as shown. Distal edge surface 32 includes a major portion 34 which is all in a single plane (except, of course, when the sole is flexed). Such bluntness of distal edge 32 improves the safety of shoe 10. The plane defined by the major portion 34 of distal edge 32 of annular cleat 26 is useful in describing an important feature of this invention.

Such feature is the passageway 42 along a portion of the annular cleat 26. Passageway 42 is between the aforementioned plane and main sole surface 16. In the preferred form shown in the drawings, passageway 42 extends from a first position 44, which is on ball-of-the-foot portion 22 near arch portion 20, across a portion of the width of sole 14 to a second position 46, which is on ball-of-the-foot portion 22 near arch portion 20. Positions 44 and 46 are both along the circular path along which annular cleat 26 extends.

Figure 5:
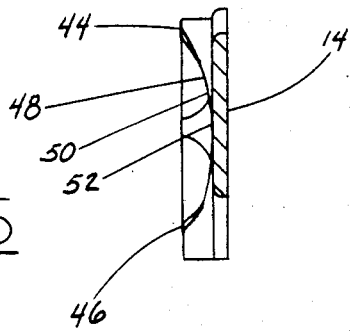
FIG. 5 is a fragmentary sectional view taken along section 5—5 as indicated in FIG. 2.

Between first and second positions 44 and 46, distal edge 32 is positioned at a level between the plane defined by major portion 34 and main sole surface 16. As best illustrated in FIG. 5, the portion of distal edge 32 between first and second positions 44 and 46 forms a concave length 48. Concave length 48 has a center portion 50 which converges toward main sole surface 16, such that annular cleat 26 is progressively shorter in length at positions progressively closer to the mid-point 52 between first and second positions 44 and 46.

The passageway which forms a part of this invention can be in a variety of forms. Instead of the preferred form shown in the drawings, in which annular cleat 26 is, in effect, drastically shortened, distal edge 32 can merge with main sole surface 16 such that a more complete void is along a minor portion of the circle along which annular cleat 26 runs, at or near the position just forward of arch portion 20. Such void, in the position just forward of arch portion 20, does not detract from the pivoting performance of the shoe. The annular cleat remains a single cleat and is still described as "substantially continuous."

Inclusion of such passageway provides certain advantages. First, by eliminating or drastically recessing such portion of annular distal edge 32, a greater amount of the athlete's weight is applied to the ground through major portion 34 of distal edge 32. This helps to insure that annular cleat 26 will penetrate the ground sufficiently to provide good traction, and to provide a good base for pivoting.

Furthermore, passageway 42 allows passage of air out of the space enclosed by annular cleat 26, main sole surface 16, and the ground as the player's foot bites into the ground. This reduces or eliminates the clapping sound which can occur if air is compressed within such space and then suddenly is released through a small passageway, such as an irregularity in the ground.

Annular cleat 26 has radially-inward and radially-outward annular lateral surfaces 36 and 38 which converge to distal edge 32. Outward lateral surface 38 is normal (that is, perpendicular) to main sole surface 16. This helps to provide as wide a base as possible to support the foot of the athlete. Inward lateral surface 36 flares radially outwardly to distal edge 32, and is curved in cross-section to merge gently with main sole surface 16, thus minimizing nooks and crannies in which mud might accumulate. Such gentle merging can be described by referring to main sole surface 16 as joining inward lateral surface 36 tangentially.

A number of generally frustoconical cleats 40 are formed on heel portion 18 of sole 14. A variety of heel cleats may be used on the shoe of this invention. The characteristics of the cleats on heel portion 18 do not form part of this invention.

While the principles of this invention have been described in connection with specific embodiments, it should be understood clearly that these descriptions are made only by way of example and are not intended to limit the scope of the invention.

What is claimed:

1. In an athletic shoe of the type having a sole with a main sole surface and cleats extending therefrom to provide traction, such sole having heel, arch, ball-of-the-foot and toe portions, the improvement comprising:

a substantially continuous annular cleat extending along a substantially circular path encompassing a major area which includes most of the ball-of-the-foot and toe portions, said path being forward of the arch portion, the cleat substantially spanning the width of the sole and having an annular distal edge a major portion of which defines a plane spaced from the main sole surface;

said annular cleat being flexible to allow flexing of the sole;

said annular cleat enclosing a sole area substantially all non-cleat portions of which are coincident with said main sole surface and having inner and outer annular surfaces angled with respect to the main sole surface and extending to intersection therewith; and a passageway in the cleat between the main sole surface and said plane and extending from a first position on the ball-of-the-foot portion near the arch portion across a portion of the width of the sole to a second position on the ball-of-the-foot portion near the arch portion, whereby both improved pivotability and traction are provided.

2. The athletic shoe of claim 1 wherein the distal edge is a flat surface, the bluntness of which improves product safety.

3. The athletic shoe of claim 1 wherein between the first and second positions the distal edge forms a concave length which has a center portion converging toward the main sole surface, such that the annular cleat is progressively shorter in length at positions progressively closer to a point between the first and second positions.

4. The athletic shoe of claim 1 wherein between the first and second positions the distal edge is between the plane and the main sole surface.

5. The athletic shoe of claim 4 wherein between the first and second positions the distal edge forms a concave length which has a center portion converging toward the main sole surface, such that the annular cleat is progressively shorter in length at positions progressively closer to a point between the first and second positions.

6. The athletic shoe of claim 5 wherein the distal edge is a flat surface, the bluntness of which improves product safety.

7. The athletic shoe of claim 1 wherein the annular cleat is centered substantially on the juncture of the ball-of-the-foot and toe portions.

8. The athletic shoe of claim 7 wherein the distal edge is a flat surface, the bluntness of which improves product safety.

9. The athletic shoe of claim 7 wherein between the first and second positions the distal edge forms a concave length which has a center portion converging toward the main sole surface, such that the annular cleat is progressively shorter in length at positions progressively closer to a point between the first and second positions.

10. The athletic shoe of claim 7 wherein between the first and second positions the distal edge is between the plane and the main sole surface.

11. The athletic shoe of claim 10 wherein between the first and second positions the distal edge forms a concave length which has a center portion converging toward the main sole surface, such that the annular cleat is progressively shorter in length at positions progressively closer to a point between the first and second positions.

12. The athletic shoe of claim 11 wherein the distal edge is a flat surface, the bluntness of which improves product safety.

13. The athletic shoe of claim 1 further including a central cleat disposed concentrically within the annular cleat.

14. The athletic shoe of claim 1 wherein the annular cleat is the forwardmost cleat.

15. The athletic shoe of claim 1 wherein the inner annular surface is curved in cross-section such that the main sole surface joins the inner surface tangentially, whereby mud accumulations are resisted.

16. The athletic shoe of claim 1 wherein the outer annular surface is substantially normal to the main sole surface.

17. The athletic shoe of claim 16 wherein said inner annular surface is curved in cross-section such that the main sole surface joins the inner annular surface tangentially, whereby mud accumulations are resisted.

* * * * *